US010538969B2

(12) United States Patent
Slaughter, Jr. et al.

(10) Patent No.: US 10,538,969 B2
(45) **Date of Patent: *Jan. 21, 2020**

(54) STACKED-PLATE REAMER

(71) Applicant: The Charles Machine Works, Inc., Perry, OK (US)

(72) Inventors: Greg L. Slaughter, Jr., Perry, OK (US); Travis W. Woodson, Orlando, OK (US); Chapman P. Hancock, Oklahoma City, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/025,035

(22) Filed: Jul. 2, 2018

(65) Prior Publication Data

US 2018/0313159 A1 Nov. 1, 2018

Related U.S. Application Data

(63) Continuation of application No. 15/174,751, filed on Jun. 6, 2016, now Pat. No. 10,036,205.

(60) Provisional application No. 62/171,025, filed on Jun. 4, 2015.

(51) Int. Cl.

| | |
|---|---|
| ***E21B 10/26*** | (2006.01) |
| ***E21B 10/60*** | (2006.01) |
| ***E21B 7/04*** | (2006.01) |
| ***E21B 7/28*** | (2006.01) |

(52) U.S. Cl.

CPC ..... *E21B 10/26* (2013.01); *E21B 7/046* (2013.01); *E21B 7/28* (2013.01); *E21B 10/60* (2013.01)

(58) Field of Classification Search

CPC . E21B 10/26; E21B 7/28; E21B 7/046; E21B 10/60; E21B 10/633; E21B 10/16

See application file for complete search history.

(56) References Cited

U.S. PATENT DOCUMENTS

| | | | | |
|---|---|---|---|---|
| 1,602,794 | A | 10/1929 | Erwin | |
| 3,902,562 | A | 9/1975 | Pessier | |
| 5,456,328 | A | 10/1995 | Saxman | |
| 5,687,807 | A | 11/1997 | Woods | |
| 5,833,015 | A | 11/1998 | Hesse et al. | |
| 6,250,403 | B1 | 6/2001 | Beckwith | |
| 6,659,198 | B2 * | 12/2003 | Camp | E21B 10/26 175/53 |
| 7,243,737 | B2 | 7/2007 | Tod | |
| 7,845,432 | B2 | 12/2010 | Salins | |
| 8,887,833 | B2 | 11/2014 | Crane | |

(Continued)

OTHER PUBLICATIONS

The Charles Machine Works, Inc. "Ditch Witch Downhole Tools" parts catalog, 2000, 2 pages, Perry, Oklahoma.

*Primary Examiner* — Daniel P Stephenson

(74) *Attorney, Agent, or Firm* — Tomlinson McKinstry, P.C.

(57) ABSTRACT

A stacked-plate system for a backreamer. The backreamer has a set of plates disposed about a central shaft for providing fluid for use in reaming operations. A distributor plate forms a cavity within a plate assembly for receiving fluid from the central shaft through radial fluid ports. Fluid from the cavity is then expelled through nozzles that overlay the cavity in a separate plate. The direction of fluid flow at the nozzles is axial, rather than toward the sidewall of the enlarged bore.

25 Claims, 8 Drawing Sheets

(56) References Cited

U.S. PATENT DOCUMENTS

| | | | | |
|---|---|---|---|---|
| 9,157,287 | B2 | 10/2015 | Slocum | |
| 9,719,344 | B2 | 8/2017 | Melsheimer | |
| 10,036,205 | B2 * | 7/2018 | Slaughter, Jr. ..... | E21B 10/60 |
| 2004/0020693 | A1 | 2/2004 | Damhof | |
| 2009/0250266 | A1 | 10/2009 | Dimitroff | |
| 2010/0012379 | A1 | 1/2010 | Wentworth | |
| 2010/0116556 | A1 | 5/2010 | Buske | |
| 2016/0356091 | A1 | 12/2016 | Slaughter, Jr. | |
| 2018/0313159 | A1 * | 11/2018 | Slaughter, Jr. ..... | E21B 10/60 |

* cited by examiner

STACKED-PLATE REAMER

FIELD

This invention relates generally to backreamers, and specifically fluid flow mechanisms for backreamers.

SUMMARY

The invention is directed to a reamer comprising a tubular shaft and a body. The tubular shaft is symmetric about a bit axis and has a radially extending fluid passage. The body is supported on the shaft and forms a plurality of layers. The body comprises a distributor layer and a spaced pair of boundary layers. The distributor layer is penetrated by an internal void having uniform cross-sectional dimension and communicating with the fluid passage. The spaced pair of boundary layers contact each side of the distributor layer and form side walls that enclose major portions of the internal void.

The invention is also directed to a bit comprising a central shaft, a first layer, a second layer and a distributor layer. The central shaft defines a longitudinal axis and has a radial fluid passage. The first layer is disposed about the central shaft and has a nozzle formed through the first layer and substantially parallel to the longitudinal axis. The second layer is disposed about the central shaft. The distributor layer is disposed about the central shaft and has a cutaway portion disposed to create an internal void in fluid communication with the radial fluid passage and the nozzle.

DETAILED DESCRIPTION

Figure 1:
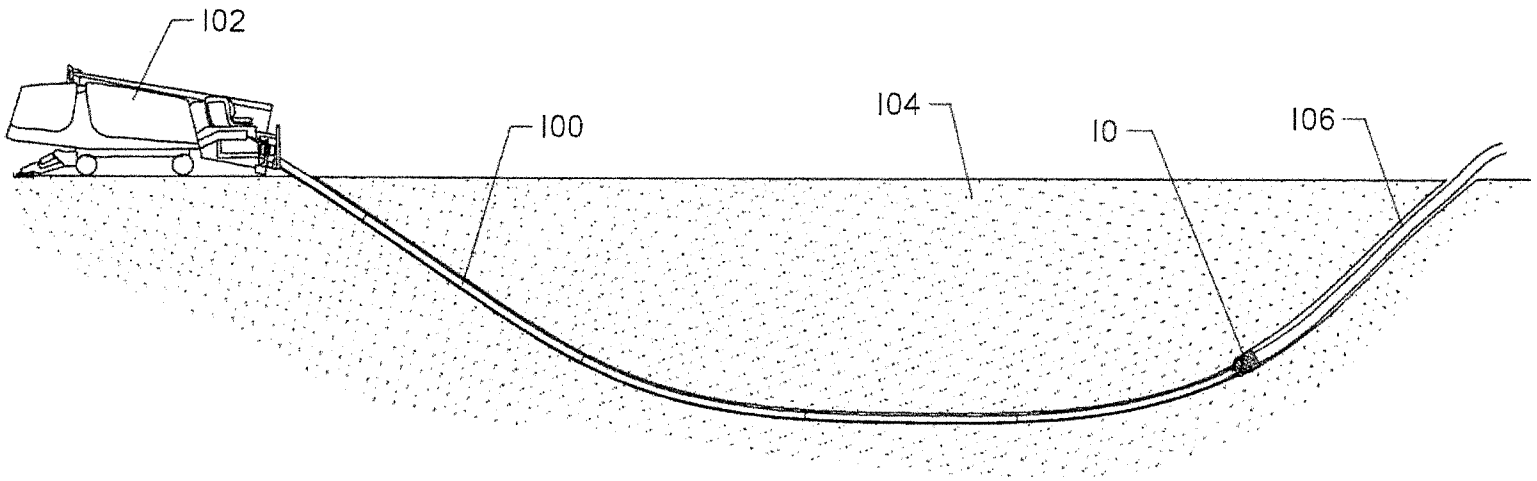
FIG. 1 is a diagrammatic representation of a backreaming operation using the backreamer of the present invention.

With reference to FIG. 1, the invention is directed to a stacked-plate backreamer 10. The reamer 10 is attached at a terminal end of a drill stem 100. In backreaming operations, a horizontal directional drill 102 drills a pilot bore into the subsurface 104. This pilot bore exits the subsurface 104 at an exit point. The reamer 10 is then placed at the terminal end of the drill stem 100. A wider product pipe 106 is attached to the reamer 10, and the reamer 10 is pulled back through the subsurface 104 by the drill stem 100, widening the borehole.

In operations as described in FIG. 1, drilling fluid, such as drilling mud or lubricant, is pumped down the drill stem into the reamer 10 and distributed within the borehole to promote cutting by the reamer during hole opening/backreaming operations. While the operations discussed herein are referred to "hole opening" or "backreaming" operations, they should be understood to include "swabbing" operations—that is, using reamer 10 to clean the pilot bore of debris without significantly expanding the radius of the borehole.

Figure 2:
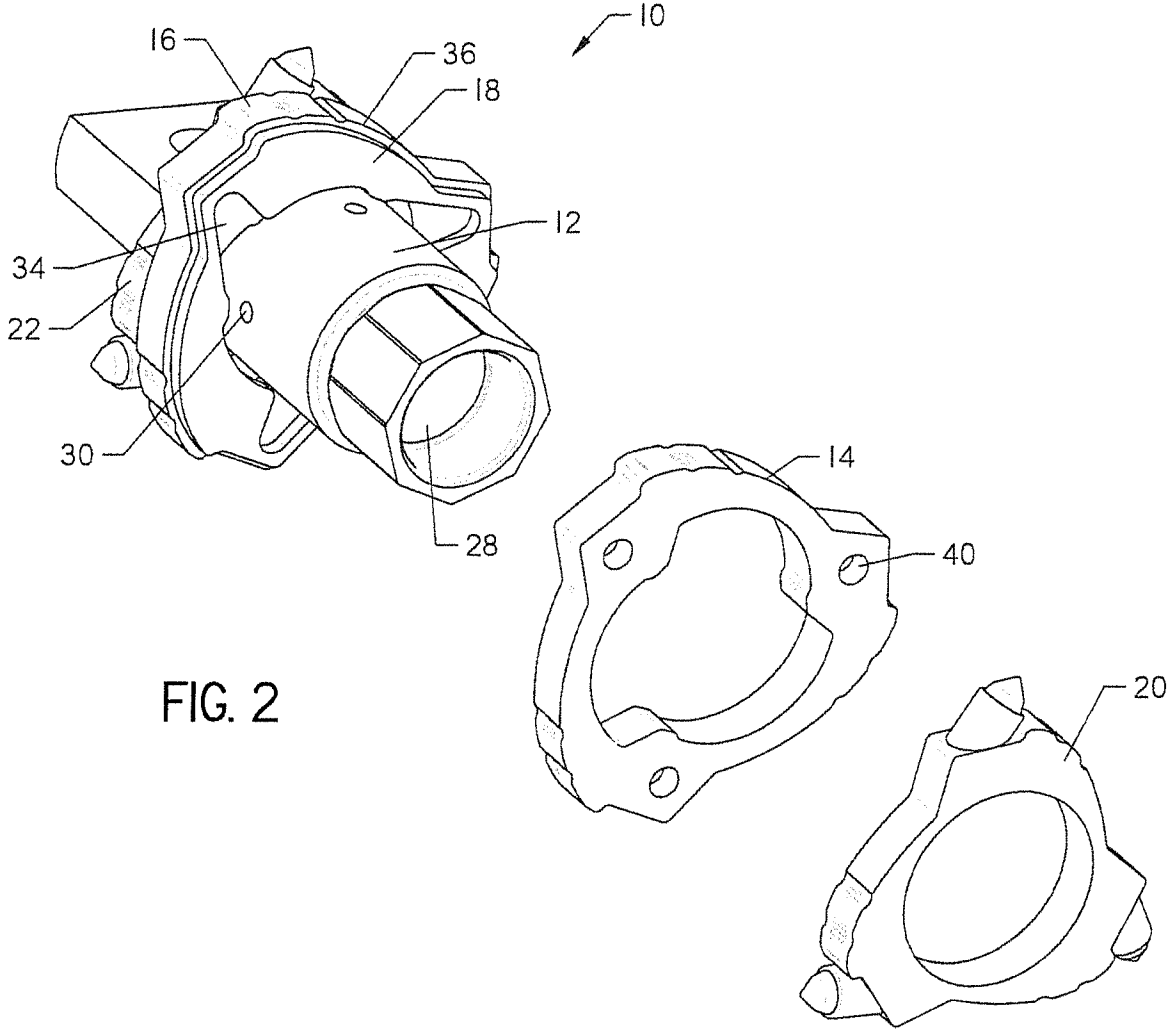
FIG. 2 is a front isometric partially exploded view of a backreamer for use with the present invention.

With reference now to FIG. 2, shown therein is an embodiment of the reamer 10. The reamer 10 comprises a central shaft 12, a first plate 14, a second plate 16, a distributor plate 18, and a cutter plate 20. The first plate 14, second plate 16, distributor plate 18, and cutter plate 20 are each disposed about the central shaft 12. A second cutter plate 22 may also be disposed about the central shaft 12. In order from closest to the HDD machine 102 (FIG. 1) to the furthest, the stacked plates are ordered cutting plate 20, first plate 14, distributor plate 18, second plate 16, second cutter plate 22.

Each of these plates may be welded or otherwise integrally connected to the central shaft 12 and to each other. Upon welding the plates together as in FIG. 3, they form a body 23 of multiple layers. External welds may connect the adjacent layers, causing the body 23 to be non-homogenous at the places that the plates are welded to make layers.

The central shaft 12 is attached at one end to the drill stem 100 (FIG. 1) and may be translated and rotated through operation of the drill stem. Each of the plates of the reamer 10 rotates integrally with the rotation of the central shaft 12. The central shaft 12 defines a central fluid flow passage 28 and at least one radially disposed fluid flow port 30. The central shaft 12 of FIG. 2 has three fluid flow ports 30 disposed 120 degrees apart on an outer surface of the central shaft.

The distributor plate 18, when disposed about the central shaft 12, defines an interior cutaway portion 34 and has a uniform cross-sectional dimension. As shown, there are three interior cutaway portions 34 disposed proximate each of the radial fluid flow ports 30 of the central shaft 12. The distributor plate 18 preferably does not extend beyond an external periphery 36 of the second plate 16 and the first plate 14. Fluid from the fluid flow ports 30 flows into into the cutaway portion 34 of distributor plate 18. The distributor plate 18 may be covered in hardfacing material (not shown) on its periphery to protect it from wear due to interaction with the subsurface.

The first plate 14 has a plurality of longitudinal bores or nozzles 40. When assembled, the nozzles 40 are positioned next to the cutaway portion 34. In this way, fluid flow is directed from ports 30, through the cutaway portion 34, and into the nozzles 40. Each nozzle 40 preferably has a longitudinal axis that is parallel to the central shaft 12. In FIG. 2, the nozzles 40 direct fluid in the direction the reamer 10 is being pulled by the drill stem 100 (FIG. 1). The first plate 14 and second plate 16 form a pair of boundary plates on each side of the distributor plate 18, covering the cutaway portion 34 creating an internal void within the body of the reamer 10 with the nozzles 40 as the only outlets.

Figure 3:
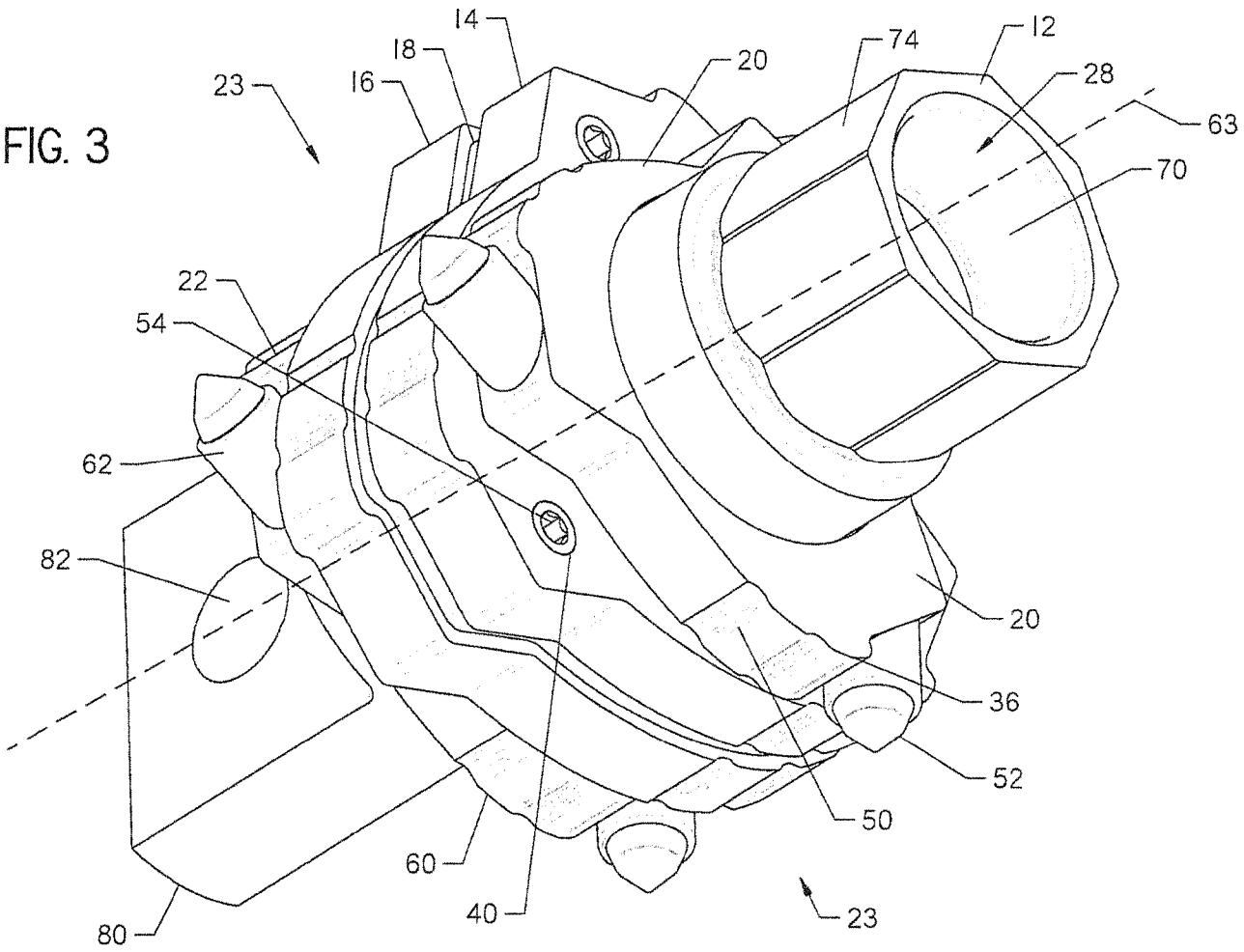
FIG. 3 is a front isometric view of the backreamer of FIG. 2.

With reference now to FIG. 3, the cutter plate 20 comprises an outer surface 50. A plurality of teeth 52 are disposed on the outer surface 50 of the cutter plate 20 and oriented in the direction of rotation. As shown, the teeth 52 extend in the clockwise direction from the outer surface 50. The outer surface 50 is shaped such that the teeth 52 extend radially beyond the external periphery 36 of the first 14 and second 16 plates. The teeth 52 therefore engage the subsurface as the reamer 10 is translated and rotated. As shown, the first cutter plate 20 comprises three teeth 52, though other numbers of teeth may be utilized. Preferably, the number of teeth 52 corresponds to the number of nozzles 40. As shown, the nozzles 40 incorporate a flow restrictor 54 to restrict the cross-sectional area of the nozzles 40 and thus increase the velocity of fluid expelled from the nozzles.

The second cutter plate 22 is similarly formed to the first cutter plate 20, and may be identically formed. The second cutter plate 22 comprises an outer surface 60 and a plurality of teeth 62 disposed on the outer surface. The teeth 62 similarly engage the subsurface.

The second plate 16, as shown in FIG. 2, does not comprise nozzles. While nozzles may optionally be included on the second plate 16, fluid directed by nozzles 40 of the first plate 14 provide sufficient fluid to enhance hole opening by softening the subsurface. The second cutter plate 22 will be moved through this softened subsurface as the reamer 10 is pulled through the pilot hole. As a result, directing fluid through nozzles 40 in the direction of reamer 10 travel will enhance the cutting of both the first 20 and second 22 cutter plates.

The teeth 52 of the first cutter plate 20 and the teeth 62 of the second cutter plate 22 are shown in substantially the same angular positions relative to a longitudinal axis 63 of the central shaft. However, teeth 52 may also be angularly offset from teeth 62. Additionally, further plates may be added in addition to the first cutter plate 20 and the second cutter plate 22 to provide more layers.

The central shaft 12 may comprise a connection point 70. The connection point 70 facilitates torque transmitting connection between the reamer 10 and the drill stem 100 (FIG. 1). This may be a threaded inner surface, pins, splines, geometrical features or other known torque transmitting features. The outer surface 72 of the central shaft 12 comprises a plurality of flat surfaces 74 to promote ease of connection and disconnection of the reamer 10 from the drill stem 100 (FIG. 1).

The reamer 10 additionally comprises a pullback feature 8*o* for connection to the product pipe 106 (FIG. 1). As shown in FIG. 3, the pullback feature 8*o* comprises a towing eye 82. The pullback feature 8*o* may be connected to the reamer 10 through a swivel assembly (not shown) or other means to enable pullback without imparting rotational forces from the reamer 10 to the product pipe 106 (FIG. 1)

Figure 4:
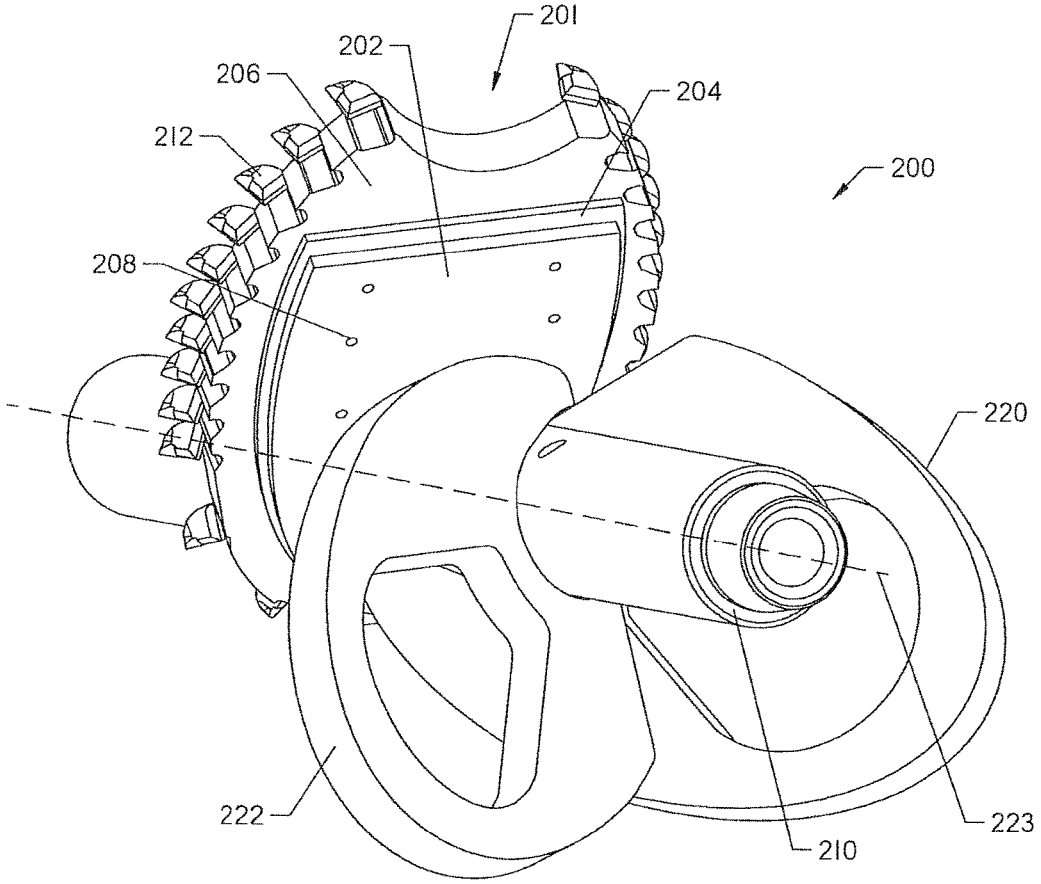
FIG. 4 is a front isometric view of an alternative embodiment of a backreamer device.

With reference now to FIG. 4, an alternative reamer 200 is shown. The reamer 200 comprises a first plate assembly 201, which comprises a first plate 202, a distributor plate 204, and a second plate 206. The first plate 202 comprises a plurality of nozzles 208. The first plate assembly 201 is disposed about a central shaft 210 of the reamer 200 at an acute angle. The second plate 206 comprises a plurality of cutting teeth 212 for enlarging a pilot bore by disrupting the subsurface as the first plate assembly 201 is rotated and pulled by the drill stem 100 (FIG. 1).

The reamer 200 also comprises additional plates 220 and 222, each also disposed about the central shaft 210 at an acute angle relative to the central shaft. As shown, two additional plates 220 are offset by 120 degrees from the first plate assembly 201, one clockwise, one counter-clockwise about axis 223. The additional plates 220, 222 may not have teeth, but rather a hard-facing material (not shown) disposed around the periphery of the plates.

The first plate assembly 201 is preferably the furthest "front" relative to the direction that the reamer 200 is pulled by the drill stem 100. In this way, fluid conveyed through the central shaft 210 through radial ports (not shown) to the distributor plate 204 for use by all the plates 201, 220, 222 of the reamer 200 to wash cuttings from proximate the reamer 200. The nozzles 208 are directed away from the direction of travel of the reamer 200, into the page in FIG. 4. This will place fluid in the path of the plates 220, 222, as well as the back end of the second plate 206.

Figure 5:
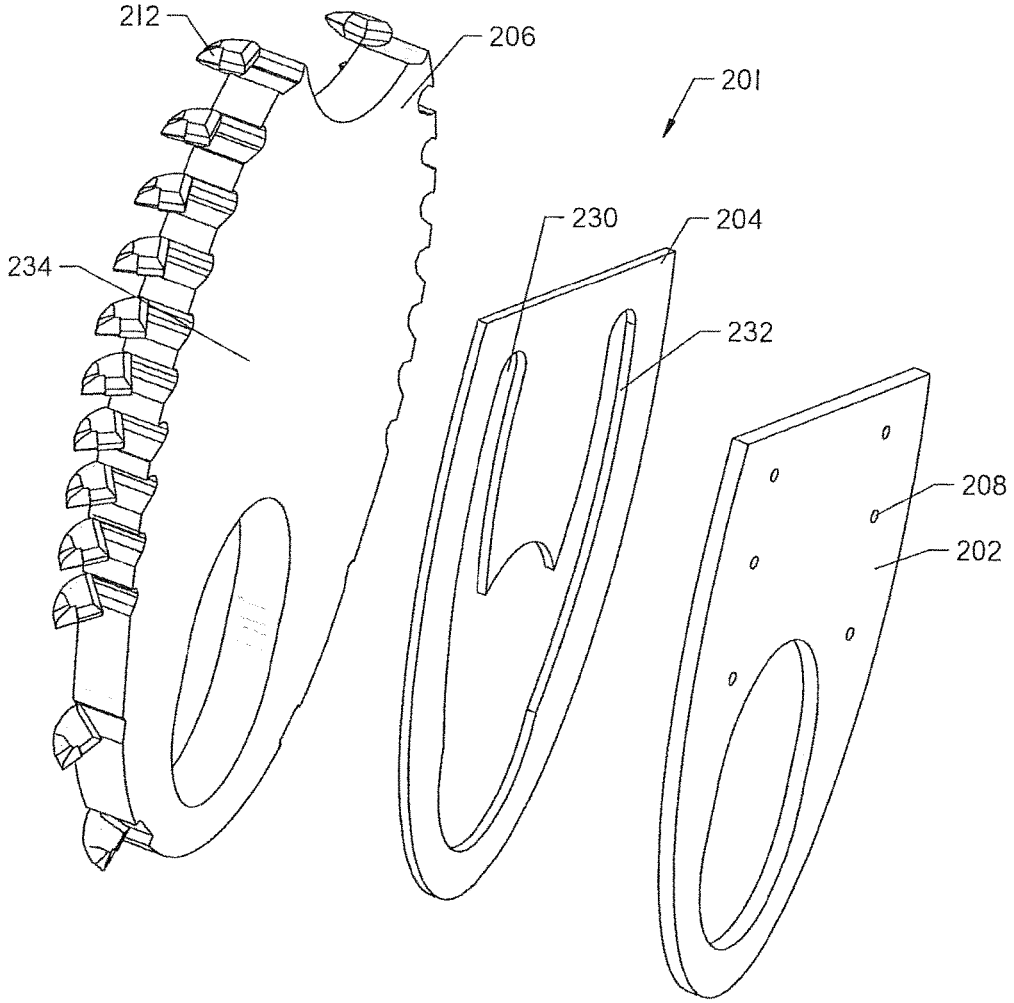
FIG. 5 is an exploded view of a plate assembly for use with the backreamer device of FIG. 4.

With reference to FIG. 5, the first plate assembly 201 is shown in exploded view. When attached to the second plate 206, the distributor plate 204 defines a cavity 230 for receiving fluid flow from radial ports (not shown) formed in the central shaft 210 (FIG. 4). The cavity 230 comprises two bays 232 corresponding to the nozzles 208 formed in the first plate 202. As shown, there are three nozzles 208 corresponding to each of the two bays 232. One of skill in the art will appreciate that other cavities may be considered, as well as other nozzle patterns, without departing from the spirit of the invention. The second plate 206 has no nozzle and thus provides a closed wall surface 234 for enclosing the cavity 230. A nozzle may optionally be placed in the second plate to provide fluid to the front side of the first plate assembly 201.

Figure 6:
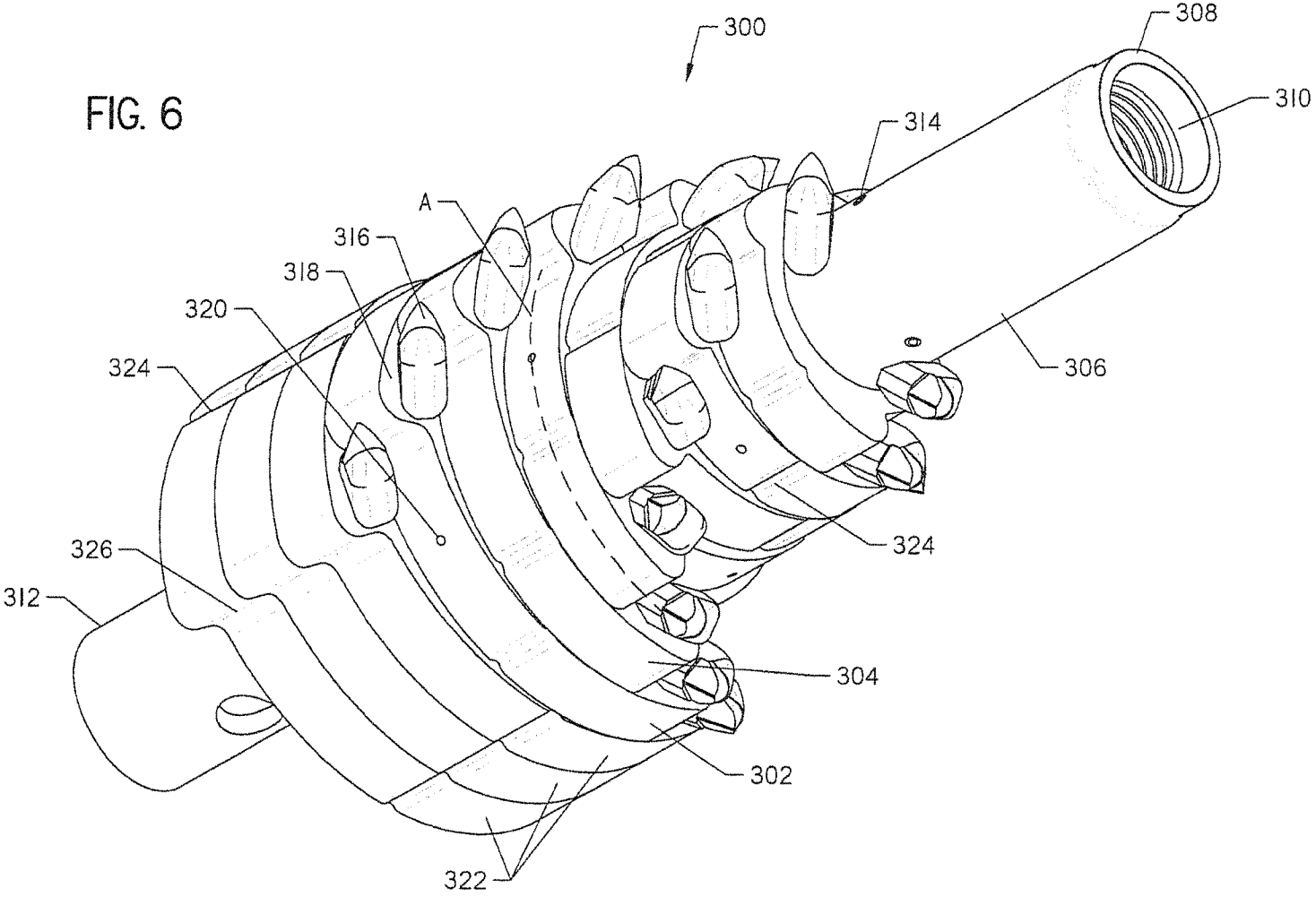
FIG. 6 is an isometric view of a prior art backreamer device.
Figure 7:
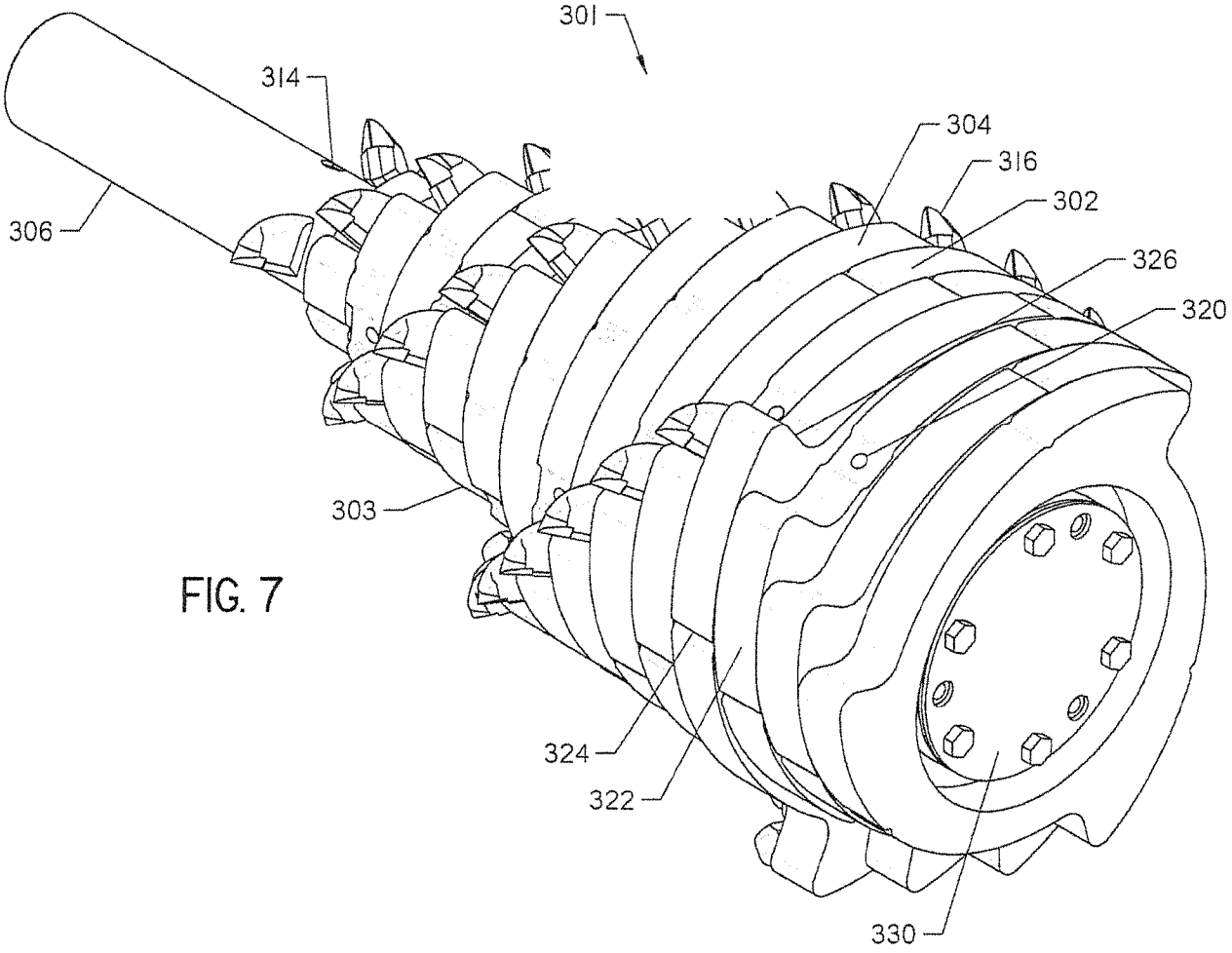
FIG. 7 is a back isometric view of a prior art backreamer device.
Figure 8:
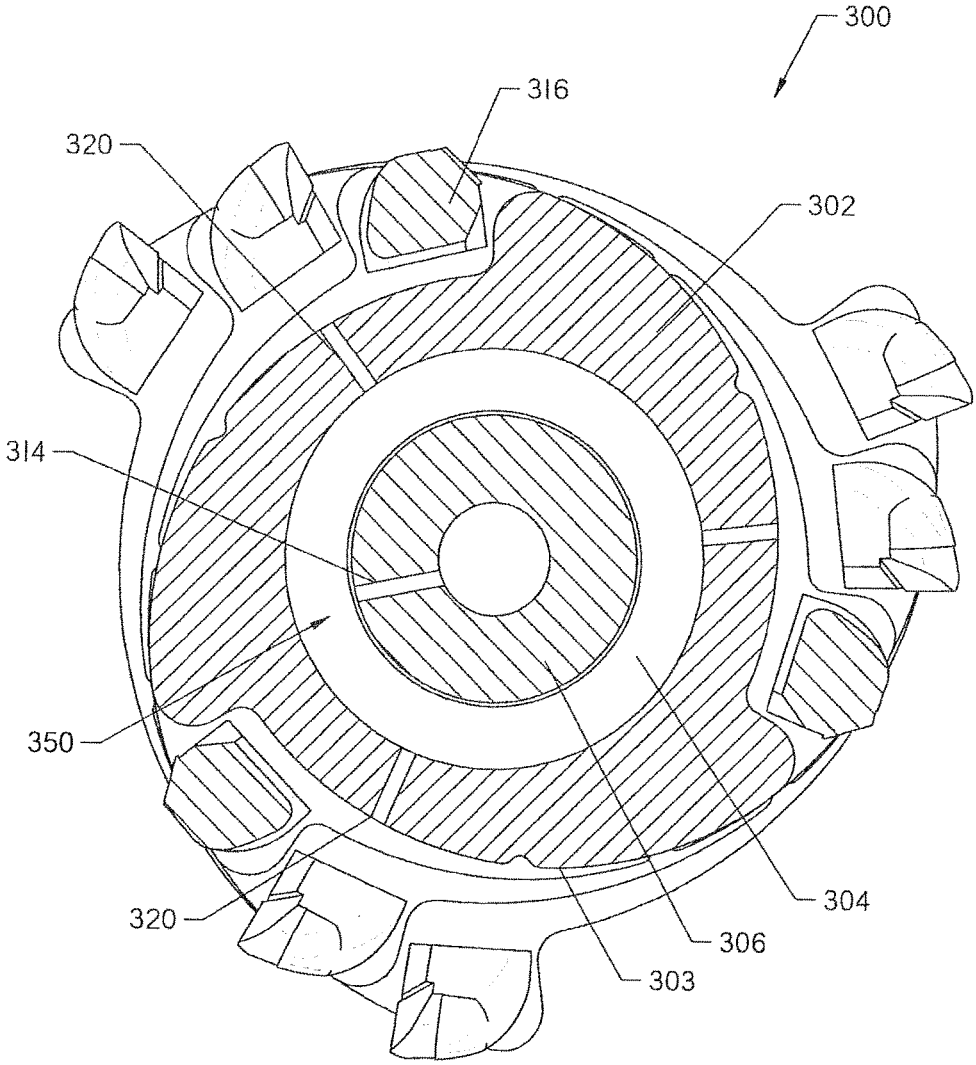
FIG. 8 is a sectional view along line A in FIG. 6 of plates for use with the prior art backreamers of FIGS. 6 and 7.

With reference now to FIGS. 6-8, shown therein is a stacked-plate reamer 300 with a prior art configuration. The reamer 300 comprises a plurality of ported plates 302 and a plurality of unported plates 304 disposed about a central shaft 306. The central shaft 306 comprises a connection point 308 for connection to the drill stem 100 (FIG. 1). As shown, the connection point 308 comprises threads 310. The reamer 300 comprises a pullback feature 312 such as a towing eye to pull a product pipe 106 (FIG. 1). The central shaft 306 comprises radial ports 314 formed in a periphery of the shaft. As shown in FIG. 6, at least some of the radial ports 314 are uncovered by plates 302, 304. The unported plates 304 and ported plates 302 each comprise teeth 316. As shown, the teeth 316 are mounted on a shelf 318 formed on a face of the plates 302, 304 and extend beyond a periphery of the preceding plates. Radially aligned nozzles 320 are formed in the ported plates 302 for providing fluid proximate the cutting teeth 316 during reaming operations.

A plurality of untoothed plates 322 may be provided in the "back" of the reamer 300 relative to the direction of travel (to the right in FIG. 6). These untoothed plates 322 smooth and clean the borehole without generating substantial additional cuttings. As shown, each of the plates 302, 304, 322 define a number of grooves 324 and cutout sections 326 in their peripheries to allow fluid and cuttings to pass behind the reamer 300 as it is pulled through the ground.

With reference now to FIG. 7, an alternative reamer 301 having many of the same component parts as the reamer 300 of FIG. 6 is shown. Reamer 301 comprises more plates 302, 304, 322 than the reamer of FIG. 6, but the ultimate design is similar. In FIG. 7, at least some of the untoothed plates 322 comprise nozzles 320. The reamer 301 has a product pipe connection point 330 disposed at its rear end (the right side in FIG. 7) for connection to a swivel or similar structure of a product pipe 106 (FIG. 1). The connection point 330 may be freely exchanged for the pullback feature 312 of FIG. 6.

With reference to FIGS. 6 and 7, upon connection of the various plates 302, 304, 322 through welding or other means, the plates each form a layer of a body 303. The layers may be formed such that the teeth 316 are positioned helically along an outside periphery of the body 303 as shown in the Figures, though artisans may conceive of other tooth orientations without departing from the scope of the invention.

With reference to FIG. 8, an internal cross-section of the reamer 300 is shown at line A of FIG. 6. The ported plate 302 encircles but does not contact the central shaft 306. A hollow region 350 is defined by an internal surface of the ported plate 302, the external surface of the central shaft 306, and the neighboring unported plates 304. Fluid flows into the aperture 350 from the central shaft 306 through fluid ports 314 (FIG. 6). The fluid then move through radial nozzles 320 to the external surface of the body 303. The nozzles 320 are located proximate the teeth 316 to aid in hole opening and cleaning operations.

One of skill in the art will appreciate that in all of the embodiments disclosed herein, multiple alternative teeth, configurations of teeth and configurations of layers may be utilized. For example, adjacent layers may comprise offset nozzles. Adjacent layers may be welded or bolted together. Hardfacing is typically used on reamers such as those disclosed herein to assist with boring operations and protect components from wear. The particular arrangement of such features and hardfacing should not be construed as a departure from the present invention. While the preferred embodiments of the invention are disclosed in the figures and specification herein, one of skill in the art will appreciate that various modifications to the embodiments above can be made without departing from the spirit of the disclosed invention.

The invention claimed is:

1. A reamer comprising:

a central shaft having a radial fluid passage;

a distributor plate disposed about the central shaft, the distributor plate having an interior cutaway portion disposed to create an internal void in fluid communication with the radial fluid passage;

a cutter; and a nozzle formed proximate the cutter, wherein the nozzle is in fluid communication with the internal void of the distributor plate and is substantially perpendicular to the radial fluid passage and substantially parallel to the central shaft.

2. The reamer of claim 1 wherein the cutter comprises a tooth.

3. The reamer of claim 1 further comprising a connection point for connecting a drill stem to the central shaft, wherein the nozzle directs fluid in the direction of the connection point.

4. The reamer of claim 1 further comprising a first layer disposed about the central shaft and abutting the distributor plate such that the first layer defines at least a portion of a passage between the internal void and the nozzle.

5. The reamer of claim 4 wherein passage of the first plate is formed through a width of the first layer.

6. The reamer of claim 4 further comprising a second layer disposed about the central shaft and abutting the distributor plate, such that the distributor plate is disposed between the first layer and the second layer.

7. The reamer of claim 6 wherein the first layer comprises a nozzle.

8. The reamer of claim 1 comprising three nozzles in fluid communication with the internal void of the distributor plate.

9. The reamer of claim 1 comprising six nozzles in fluid communication with the internal void of the distributor plate.

10. A backreaming system comprising:

a horizontal directional drill;

a drill stem operationally connected to the horizontal directional drill; and the reamer of claim 1 operatively connected to the drill stem;

wherein the central shaft of the reamer comprises a connection point for connection to the drill stem.

11. The backreaming system of claim 10 wherein the nozzle is oriented toward the connection point.

12. The backreaming system of claim 10 wherein the reamer further comprises a towing eye supported away from the connection point.

13. The backreaming system of claim 12 wherein the towing eye is connected to a product pipe.

14. A reamer comprising:

a rotatable central shaft having a radial fluid passage;

a plurality of cutters disposed about the central shaft such that the cutters rotate with the central shaft;

a plurality of nozzles disposed proximate the cutters, in which at least one of the plurality of nozzles is substantially parallel to the central shaft; and a distributor plate disposed about the central shaft; the distributor plate having an interior cutaway portion disposed to create an internal void in fluid communication with the radial fluid passage and the plurality of nozzles.

15. The reamer of claim 14 further comprising a first plate section defining a longitudinal bore in fluid communication with the internal cutaway portion of the plate and one of the plurality of nozzles.

16. The reamer of claim 15 in which the longitudinal bore is circumscribed by the first plate section.

17. A reamer comprising:

a central shaft having a radial fluid passage;

a first layer disposed about the central shaft, having a nozzle formed through the first layer;

a second layer disposed about the central shaft; and a distributor layer disposed about the central shaft between the first layer and the second layer, the distributor layer having an interior cutaway portion disposed to create an internal void bounded by the first layer, the second layer, the central shaft, and the distributor layer, the internal void in fluid communication with the radial fluid passage and the nozzle.

18. The reamer of claim 17 wherein a plurality of cutting teeth are supported on an external surface of the second layer.

19. The reamer of claim 17 further comprising a connection point for connecting a drill stem to the central shaft, wherein the nozzle directs fluid in the direction of the connection point.

20. The reamer of claim 17 further comprising a first cutter layer disposed about the central shaft and adjacent to the first layer, wherein a plurality of cutting teeth are supported on an external surface of the first cutter layer.

21. The reamer of claim 20 wherein the nozzle of the first layer is formed through a width of the first layer.

22. The reamer of claim 21 further comprising a second cutter layer disposed about the central shaft and adjacent to the second layer, the second cutter layer supporting a plurality of cutting teeth.

23. The reamer of claim 17 wherein the nozzle is substantially parallel to the fluid passage.

24. A backreaming system comprising:

a horizontal directional drill;

a drill stem operationally connected to the horizontal directional drill; and the reamer of claim 17 operatively connected to the drill stem;

wherein the central shaft of the reamer comprises a connection point for connection to the drill stem.

25. The backreaming system of claim 24 further comprising:

a towing eye supported away from the connection point;
and
a product pipe attached to the towing eye.

* * * * *